US008620173B2

(12) United States Patent
Wagatsuma

(10) Patent No.: US 8,620,173 B2
(45) Date of Patent: Dec. 31, 2013

(54) IMAGE FORMING DEVICE WITH FUSION DEVICE DRIVEN BASED ON SURFACE TEMPERATURE OF FUSION ROLLER AND PRESSURE APPLICATION ROLLER

(75) Inventor: Eiji Wagatsuma, Tokyo (JP)

(73) Assignee: Oki Data Corporation, Tokyo (JP)

( * ) Notice: Subject to any disclaimer, the term of this patent is extended or adjusted under 35 U.S.C. 154(b) by 484 days.

(21) Appl. No.: 12/887,210

(22) Filed: Sep. 21, 2010

(65) Prior Publication Data

US 2011/0081158 A1 Apr. 7, 2011

(30) Foreign Application Priority Data

Oct. 2, 2009 (JP) ..... 2009-230150

(51) Int. Cl.
*G03G 15/20* (2006.01)
*G03G 15/00* (2006.01)

(52) U.S. Cl.
USPC ..... 399/70; 399/69; 399/43

(58) Field of Classification Search
USPC ..... 399/43, 44, 68–70
See application file for complete search history.

(56) References Cited

U.S. PATENT DOCUMENTS

| | | | | |
|---|---|---|---|---|
| 4,385,826 A * | 5/1983 | Itoh | ..... | 399/70 |
| 2003/0039480 A1* | 2/2003 | Omoto et al. | ..... | 399/69 |
| 2009/0028590 A1* | 1/2009 | Nanataki et al. | ..... | 399/44 |

FOREIGN PATENT DOCUMENTS

| | | | | | |
|---|---|---|---|---|---|
| JP | 08-248810 A | | 9/1996 | | |
| JP | 08248810 A | * | 9/1996 | ..... | G03G 15/20 |
| JP | 2002132086 A | * | 5/2002 | ..... | G03G 15/20 |
| JP | A-2002-132086 | | 5/2002 | | |
| JP | 2002-251099 A | | 9/2002 | | |
| JP | 2003066765 A | * | 3/2003 | ..... | G03G 15/20 |
| JP | 2005-003818 A | | 1/2005 | | |

OTHER PUBLICATIONS

Machine translation of JP08-248810.*
Machine translation of JP2002-132086.*
Machine translation of JP2003-066765.*

* cited by examiner

*Primary Examiner* — David Gray
*Assistant Examiner* — Andrew Do
(74) *Attorney, Agent, or Firm* — Muncy, Geissler, Olds & Lowe, PLLC

(57) ABSTRACT

An image forming device fusing a developer transferred to a recording medium surface based on inputted print data includes a heat source, a fusion member supported in a freely rotatable manner and heated by the heat source, a pressure application member positioned to face the fusion member and pressing against the fusion member, a temperature detection device positioned to face the pressure application member and detecting a surface temperature of the pressure application member, and a temperature control part controlling a heating temperature by the heat source based on a detection result by the temperature detection device. The temperature control part selects a second set temperature that is lower than a preset first set temperature when the surface temperature of the pressure application member detected by the temperature detection device is less than a predetermined temperature, to control a temperature of the fusion member.

18 Claims, 14 Drawing Sheets

<Carry Length, Sheet Length, Length Between Sheets>

| | | |
|---|---|---|
| Carry length | 550 mm | Length from a sheet supply roller to an eject roller |
| Sheet length | 297 mm | Length of an A4 sheet |
| Length between sheets | 60 mm | Length from a rear end of a sheet to a front end of the next sheet during continuous printing |

Fig. 5A

<Time Required To Complete Ejecting Sheet>

| | 26 ppm 158 mm/s | 16 ppm 97.5 mm/s | Time Difference |
|---|---|---|---|
| 1st | 5.36 | 8.69 | 3.33 |
| 2nd | 7.62 | 12.3 | 4.73 |
| | (Sec) | (Sec) | (Sec) |

Fig. 5B

| | | Temp. of Pressure Application Roller | | |
|---|---|---|---|---|
| Print Speed | Temp. of Fusion Roller | 50°C | 70°C | 90°C |
| 26 ppm | 177°C | × | × | ○ |
| 16 ppm | 157°C | ○ | ○ | ○ |

○: Good Fusion
×: Poor Fusion

Fig. 6

The printing is commenced in the LTLS mode if the print data is received in the region Δt, that is, in the region from TimeStart to TimerOut. (Figs. 8A and 8B)

The printing is commenced in the HTHS mode if the print data is received after Δt has elapsed. (Fig. 8C)

IMAGE FORMING DEVICE WITH FUSION DEVICE DRIVEN BASED ON SURFACE TEMPERATURE OF FUSION ROLLER AND PRESSURE APPLICATION ROLLER

CROSS REFERENCE TO RELATED APPLICATION

The present application is related to, claims priority from and incorporates by reference Japanese Patent Application number 2009-230150, filed on Oct. 2, 2009.

TECHNICAL FIELD

The present invention relates to an image forming device that performs heat fusion in image forming processes in a printer device, a facsimile machine, a photocopy machine and the like.

BACKGROUND

In an electrographic image forming device in a conventional printer device, facsimile machine, photocopy machine and the like, an electrostatic latent image is formed on a surface of a photosensitive drum, which is an image carrier body, by illuminating light based on inputted print data using an exposure apparatus, such as a light emitting diode (LED) head, after uniformly charging the surface by a charge member, such as a charge roller.

Then, by electrostatically attaching a developer to the electrostatic latent image formed on the surface of the photosensitive drum by a developer supply member, such as a development roller, a developer image is inversely developed. The developer image formed on the surface of the photosensitive drum is transferred to a recording medium carried at a predetermined timing by a transfer member, such as a transfer roller. The recording medium, to which the developer image has been transferred, is carried to a fuser thereafter, and the developer image is fixed to the recording medium by applying heat or pressure. The recording medium, to which the developer image has been fixed, is ejected outside the image forming apparatus to complete the series of the image forming processes.

In the image forming apparatus having such a configuration, the fuser generally includes a fusion roller having a heat body as a heat source, and a pressure application roller positioned to apply pressure to the fusion roller. The fusion roller and the pressure application roller are maintained in a state to press each other, and heat and pressure are applied when the recording medium passes a nip part formed by the rotating fusion roller and pressure application roller. Herein, the nip part is defined as an area where the two rollers contact and where a sheet passing through the rollers is pressed.

Japanese Laid-Open Patent Application Publication No. 2002-132086, for example, provides an image forming device that includes two print modes: a high temperature and high speed (HTHS) print mode that sets a high temperature for the above-discussed fuser and rotates the fusion roller at high speed; and a low temperature and low speed (LTLS) print mode that sets a lower temperature for the fuser and rotates the fusion roller at a slower speed than the HTHS print mode. The image forming device performs the printing by switching between the HTHS print mode and the LTLS print mode in response to the number of sheets to be printed.

However, in the image forming device of the above related art, the printing is performed in the LTLS print mode, in which the rotation speed of the fusion roller is slower, when the printing number of sheets is less than a predetermined number even if the temperature of the fuser is sufficiently high. Therefore, there is a problem that a long time is required to complete the printing for such a printing mode.

In view of such a problem, the present invention has an object to provide an image forming device that reduces the time required to complete printing by performing the printing in an optimum print mode selected based on a result of detecting the surface temperature of the pressure application roller.

SUMMARY

To solve the above-discussed problems, an image forming device according to the present invention heats and fuses a developer transferred to a surface of a recording medium based on inputted print data. The image forming device includes a heat source, a fusion member that is supported in a freely rotatable manner and that is heated by the heat source, a pressure application member that is positioned to face the fusion member and that presses against the fusion member, a temperature detection part that is positioned to face the pressure application member and that detects a surface temperature of the pressure application member, and a temperature control part that controls a heating temperature by the heat source based on a detection result by the temperature detection part. The temperature control part selects, as a target temperature, a second set temperature that is lower than a preset first set temperature when the surface temperature of the pressure application member detected by the temperature detection part is less than a predetermined temperature, to control a temperature of the fusion member.

In another aspect of the present invention, an image forming device according to the present invention includes, a heat source, a freely rotatable fusion member that is heated by the heat source, a pressure application member that is biased against the fusion member and that is heated by the fusion member, a first temperature detector that is positioned adjacent to the pressure application member and that is configured to detect a surface temperature of the pressure application member, a second temperature detector that is positioned adjacent to the heat fusion member and that is configured to detect a surface temperature of the heat fusion member, and a controller that is configured to control the heat source based on the surface temperature of the pressure application member that is detected by the first temperature detector, and to commence printing in one of a Low Temperature Low Speed (LTLS) mode and a High Temperature High Speed (HTHS) mode based on an input timing of print data and on a temperature of the heat fusion member that is detected by the second temperature detector.

According to the present invention, in an image forming device, a method of selecting between a Low Temperature Low Speed (LTLS) printing mode and a High Temperature High Speed (HTHS) printing mode includes initiating a warm-up operation to heat a fusion roller, causing the fusion roller to rotate when a temperature of the fusion roller becomes greater than a rotation starting temperature, determining if an amount of elapsed time from the initiating of a warm-up operation is less than or equal to a predetermined value when the temperature of the fusion roller is greater than or equal to a set temperature for the LTLS mode, executing printing in the LTLS mode when the amount of elapsed time is less than or equal to the predetermined value, and executing printing in the HTHS mode when the amount of elapsed time is greater than the predetermined value.

According to the present invention, in an image forming device, a method of printing in a High Temperature High Speed (HTHS) printing mode includes initiating a warm-up operation to heat a fusion roller, causing the fusion roller to rotate when a temperature of the fusion roller becomes greater than a rotation starting temperature, determining if the temperature of the fusion roller is greater than or equal to a set temperature for the HTHS mode, and executing printing in the HTHS mode when the amount of elapsed time is greater than the predetermined value.

With the image forming device according to the present invention, the time required to complete printing can be reduced by performing the printing in an optimum print mode selected based on a result of detecting the surface temperature of the pressure application roller.

BRIEF DESCRIPTION OF DRAWINGS

FIGS. 5A and 5B describe an LTLS print mode and an HTHS print mode.

FIG. 6 describes the LTLS print mode and the HTHS print mode.

DETAILED DESCRIPTION

An embodiment of the present invention is explained below with reference to the drawings. The present invention is not limited to the below description and may be appropriately modified within a scope that does not depart from the concept of the present invention.

First Embodiment

In the explanation of a first embodiment, a structure of a printer 1 is discussed as an image forming device according to the present invention.

Figure 1:
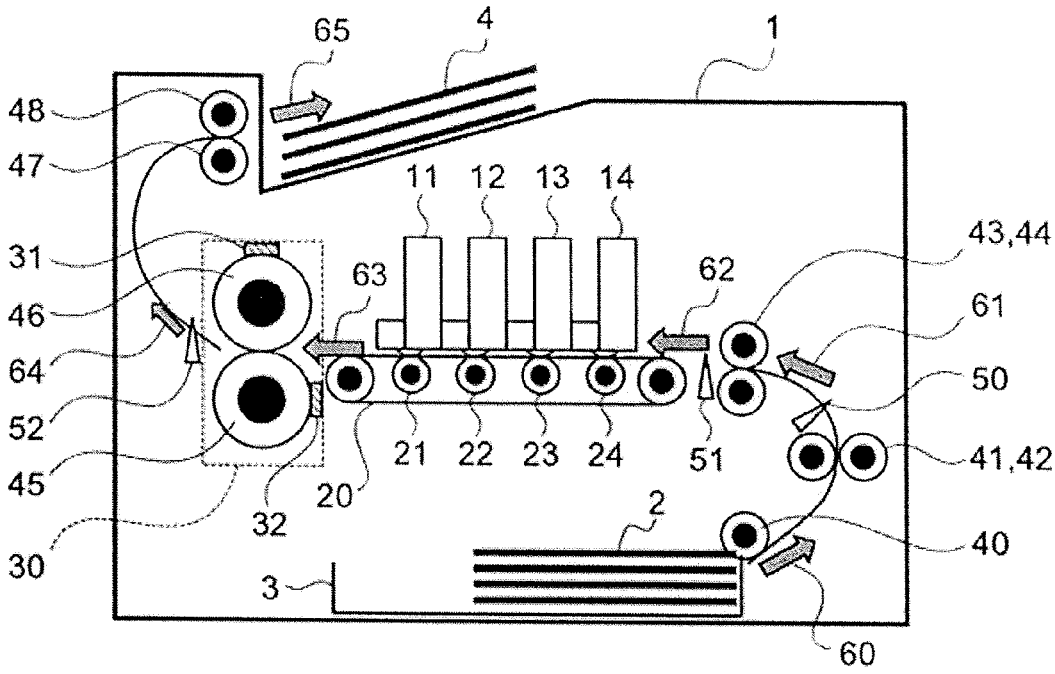
FIG. 1 is a side cross-sectional view for explaining the main structure of a printer 1.

FIG. 1 is a side cross-sectional view of the main structure of the printer 1. The printer 1 is an electrographic image forming device that can form an image on a recording medium based on print data inputted from an external device, such as a host computer.

The printer 1 includes a medium cassette 3 in which a recording medium 2 is placed, and a pickup roller 40 that feeds the recording medium 2 in the direction of an arrow 60. The printer 1 also includes a pickup roller 41 and a resist roller 42 that feed the recording medium 2 fed from the pickup roller 40 in the direction of an arrow 61, and carrying rollers 43 and 44 that carry the recording medium 2 in the direction of an arrow 62 while correcting an oblique passage of the recording medium 2. The printer 1 further includes electrographic process units 11, 12, 13 and 14 that form a developer image with respective colors on the recording medium 2, and transfer rollers 21, 22, 23 and 24 positioned to contact photosensitive drums (not shown) included respectively in the electrographic process units 11, 12, 13 and 14, via a transfer belt 20 that carries the recording medium 2 with static electricity force in the direction of an arrow 63. Moreover, the printer 1 includes a fusion unit 30 as a fuser that applies heat and pressure to the recording medium 2 to which the developer image has been transferred, ejection rollers 47 and 48 that eject the recording medium 2 that has passed the fusion unit 30 and is carried in the direction of an arrow 64 outside the printer in the direction of an arrow 65, and medium passage sensors 50, 51 and 52 that detect passage of the recording medium 2.

The medium cassette 3 internally stores the recording medium 2 in a stacking manner and is removably attached to a lower part of the printer 1. The pickup roller 40 that feeds the recording medium 2 sheet by sheet by separating the media 2 is provided at an upper part of the medium cassette 3.

The pickup roller 41 and the resist roller 42 are positioned to press against each other. The pickup roller 41 and the resist roller 42 are rotated by a driving force transmitted from a drive source and carry the recording medium 2 fed from the medium cassette 3 in the direction of the arrow 61.

The carrying rollers 43 and 44 are positioned to press against each other. The carrying rollers 43 and 44 correct the oblique passage of the recording medium 2 and are rotated by the drive force transmitted from the drive source to carry the recording medium 2 in the direction of the arrow 62 in the drawing, that is, to each of the electrographic process units 11, 12, 13 and 14.

The electrographic process units 11, 12, 13 and 14 hold toner as developer corresponding to cyan, magenta, yellow and black, respectively, and form developer images (or toner images) based on the input print data on the respective photosensitive drums. In addition, each of the electrographic process units 11, 12, 13 and 14 is mounted along the transfer belt 20 and removably from the printer 1.

The transfer belt 20 is an endless belt member that carries the recording media 2 with static electricity force. The transfer rollers 21, 22, 23 and 24 are transfer members that transfer to the recording medium 2 the toner image formed on the photosensitive drum of each of the electrographic process units 11, 12, 13 and 14. A transfer roller power source (not shown), which applies a bias voltage that has a reverse electric polarity with respect to the toner, is connected to the transfer rollers 21, 22, 23 and 24. The toner image formed on the photosensitive drums is transferred to the recording medium 2 using the bias voltage applied from the transfer roller power source.

Figure 2:
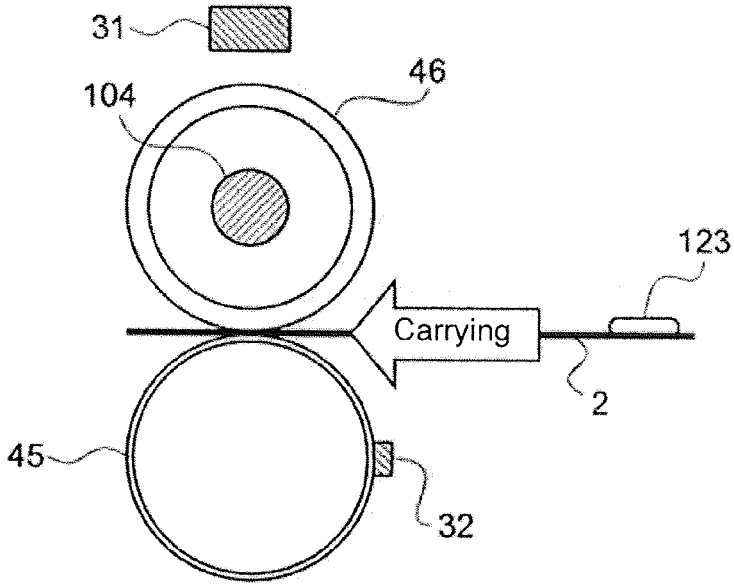
FIG. 2 illustrates a fusion unit.
Figure 3A:
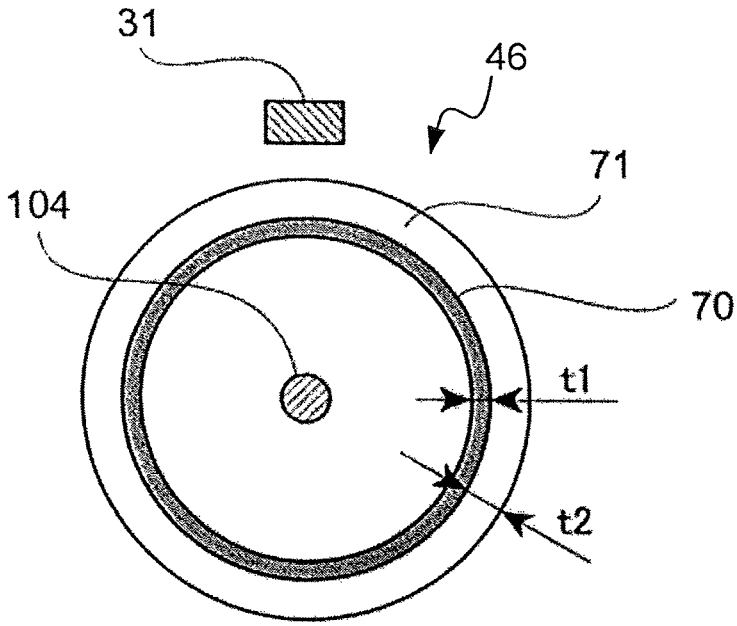
FIG. 3A illustrates a configuration of a fusion roller.
Figure 3B:
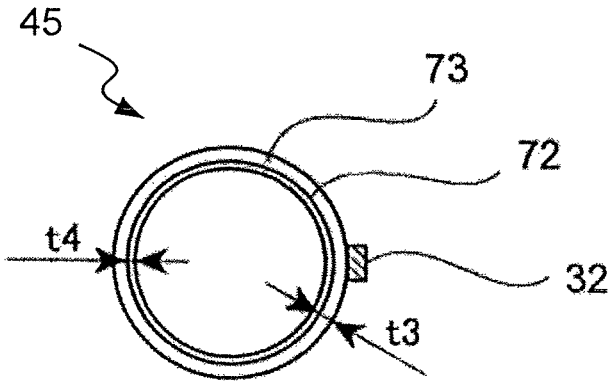
FIG. 3B illustrates a configuration of a pressure application roller.

As shown in FIG. 2, the fusion unit 30 includes a fusion roller 46 as a fusion member, a pressure application roller 45 as a pressure application member, a fusion roller temperature detection element 31, and a pressure application roller temperature detection element 32 as a temperature detection device. The pressure application roller 45 is positioned to press, or to be biased, against the fusion roller 46. Heat and pressure are applied to the recording medium 2 when the recording medium 2, on which a toner image 123 has been transferred, passes a nip part formed by the fusion roller 46 and the pressure application roller 45, and thereby the toner image 123 is fixed to the recording medium 2. As shown in FIG. 3A, the fusion roller 46 is formed by covering a hollow cylindrical core 70 made of iron, aluminum or the like with a heat-resistant elastic layer 71, such as a silicon rubber, and further with a tetra fluoro ethylene perfluoro alkyl vinyl ether copolymer (PFA) tube (not shown), for example. In the core 70, a heater 104, such as a halogen lamp, is provided as a heat source. A thickness t1 for the core 70 according to the present embodiment is 0.5 mm, and a thickness t2 for the heat-resistant elastic layer 71 is 0.8 mm. The heat capacity decreases as the thicknesses t1 and t2 decrease. Moreover, as shown in FIG. 3B, the pressure application roller 45 is formed by covering a hollow cylindrical core 72 made of iron, aluminum or the like with a heat-resistant elastic layer 73, such as silicon rubber, and further with a PFA tube, for example. A thickness t3 for the core 72 according to the present embodiment is 0.5 mm, and a thickness t4 for the heat-resistant elastic layer 73 is 0.8 mm. The heat capacity decreases as the thicknesses t3 and t4 decrease. Further, the fusion roller temperature detection element 31 is for detecting a surface temperature of the fusion roller 46, and a thermistor or the like may be used. The pressure application roller temperature detection element 32 is for detecting a surface temperature of the pressure application roller 45, and a thermistor or the like may be used.

The ejection rollers 47 and 48 are positioned to press against each other. The ejection rollers 47 and 48 are rotated by a drive force transmitted from the drive source, and eject the recording medium 2, on which the toner image is fixed by the fusion unit 30, outside the printer 1 in the direction of the arrow 65.

The medium passage sensors 50, 51 and 52 are members that output information as to whether or not the recording medium 2 has passed the respective sensor. The medium passage sensors 50, 51 and 52 may be mechanical sensors that can detect the recording medium 2 by mechanical motion or optical sensors that use reflection or transmission of light.

Figure 4:
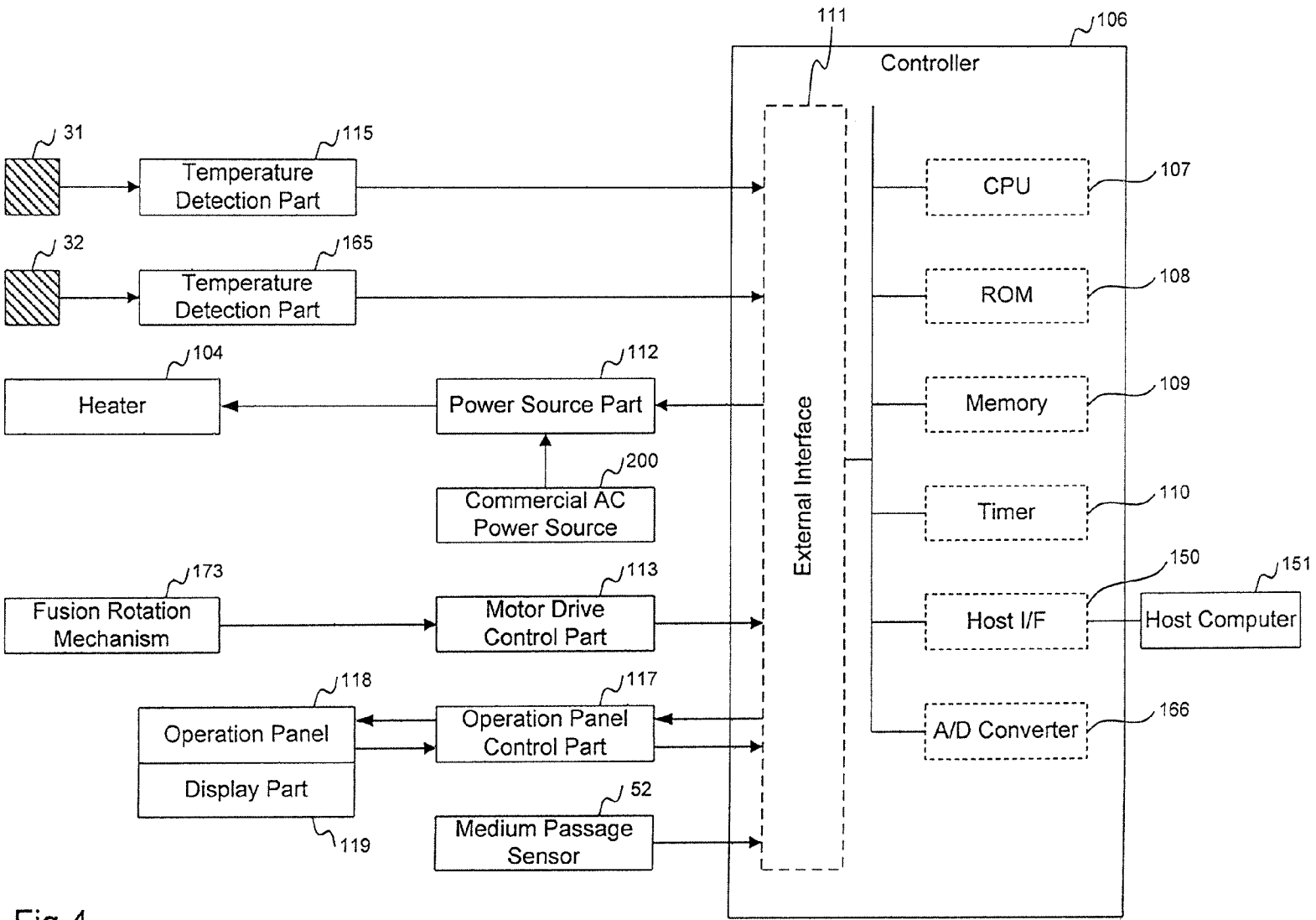
FIG. 4 is a functional block diagram for explaining a functional structure of the printer.

Next, the functional structure of the printer 1 is explained with reference to FIG. 4. A controller 106 generally controls the entire operation of the printer 1 and includes a central processing unit (CPU) 107 that achieves functions of the printer 1 by executing a control program stored in a read only memory (ROM) 108 that is a nonvolatile storage medium that stores the above-discussed control program, set data and the like, a memory 109 such as a random access memory (RAM) that is used as a working area for the CPU 107 and that temporarily stores data, such as image data, a timer 110 as a timer device, an external interface 111 that controls bidirectional communication of control signals with each control part, such as a motor drive control part 113, included in the printer 1, a host I/F (interface) 150 that controls bidirectional communication of data with an externally connected device, such as a host computer 151, and an analog-digital (A/D) converter 166 that converts analog signals outputted from a temperature detection part 115, a temperature detection part 165 or the like, into digital signals.

To the external interface 111, the temperature detection part 115, the temperature detection part 165, a power source part 112, the motor drive control part 113, an operation panel control part 117 and the medium passage sensor 52 are connected. The controller 106 achieves the functions of the printer 1 by generally controlling these parts through the external interface 111.

The temperature detection part 115 detects a surface temperature value of the fusion roller 46 based on an output from a fusion roller temperature detection element 31 connected thereto by a connector (not shown) and outputs the detected surface temperature value to the controller 106. The fusion roller temperature detection element 31 may or may not contact the fusion roller 46. The temperature detection part 165, as the temperature detection device, detects a surface temperature value of the pressure application roller 45 based on an output from a pressure application roller temperature detection element 32 connected thereto by a connector (not shown) and outputs the detected surface temperature value to the controller 106. A side of the pressure application roller temperature detection element 32 that detects the temperature is positioned to face the surface of the pressure application roller 45. The surface of the pressure application roller 45 and the pressure application roller temperature detection element 32 may contact one another or may have a small gap therebetween. In the present embodiment, the pressure application roller temperature detection element 32 and the pressure application roller 45 are configured to contact each other to increase the responsiveness of the temperature detection.

The power source part 112 supplies electric power supplied from a commercial AC power source 200 to the heater 104 based on a control signal from the controller 106.

The motor drive control part 113 controls rotation of the fusion roller 46 through a fusion rotation mechanism 173 based on a control signal from the controller 106.

The operation panel control part 117 controls an operation panel 118 formed from a touch panel or the like and a display part 119 formed from a liquid crystal display (LCD) or the like to receive configuration inputs by the user from the operation panel 118 and to display the status of the printer 1 on the display part 119.

As discussed above, the medium passage sensor 52 detects the recording medium 2, on which the toner image 123 has been fixed, after passing the nip part formed by the fusion roller 46 and the pressure application roller 45 as shown in FIG. 2.

Next, an operation according to the present embodiment is described. First, terminologies used in the explanation of the embodiment are defined.

As shown in FIGS. 5A and 5B, in the present embodiment, A4-size sheets having a recording medium length of 297 mm are used. A length from the pickup roller 40 to the ejection rollers 47 and 48 is set to 550 mm, and a length from the rear end of the sheet to the front end of the next sheet during the continuous printing is set to 60 mm. A printing speed of the fusion roller under the HTHS print mode is 26 pages per minute (ppm), and the speed for carrying the recording medium at that time is defined at 158 mm/s. A printing speed of the fusion roller under the LTLS print mode is 16 ppm, and the speed for carrying the recording medium at that time is defined at 97.5 mm/s. Therefore, under the HTHS print mode, the time required to complete ejecting the first recording medium is 5.36 seconds, and the time required to complete ejecting the second recording medium is 7.62 seconds. In addition, under the LTLS print mode, the time required to complete ejecting the first recording medium is 8.69 seconds, and the time required to complete ejecting the second recording medium is 12.3 seconds. As such, between the HTHS print mode and the LTLS print mode, the time difference required to complete ejecting the first recording medium is 3.33 seconds, and the time difference required to complete ejecting the second recording medium is 4.73 seconds.

Moreover, as shown in FIG. 6, in the present embodiment, the surface temperature of the fusion roller 46 under the HTHS print mode is defined at 177° C. as the first set temperature, and the surface temperature of the fusion roller 46 under the LTLS print mode is defined at 157° C. as the second set temperature. Further, as shown in FIG. 6, the surface temperature of the pressure application roller 45, at which good fusion is achieved, differs in the HTHS print mode and the LTLS print mode. Therefore, in the present embodiment, either the first or second set temperature is selected depending on the temperature condition of the pressure application roller 45 as shown in FIG. 6, that is, whether the surface temperature of the pressure application roller 45 at the time of starting the power supply to the printer 1 is equal to or greater than 50° C., or less than 50° C.

Figure 7:
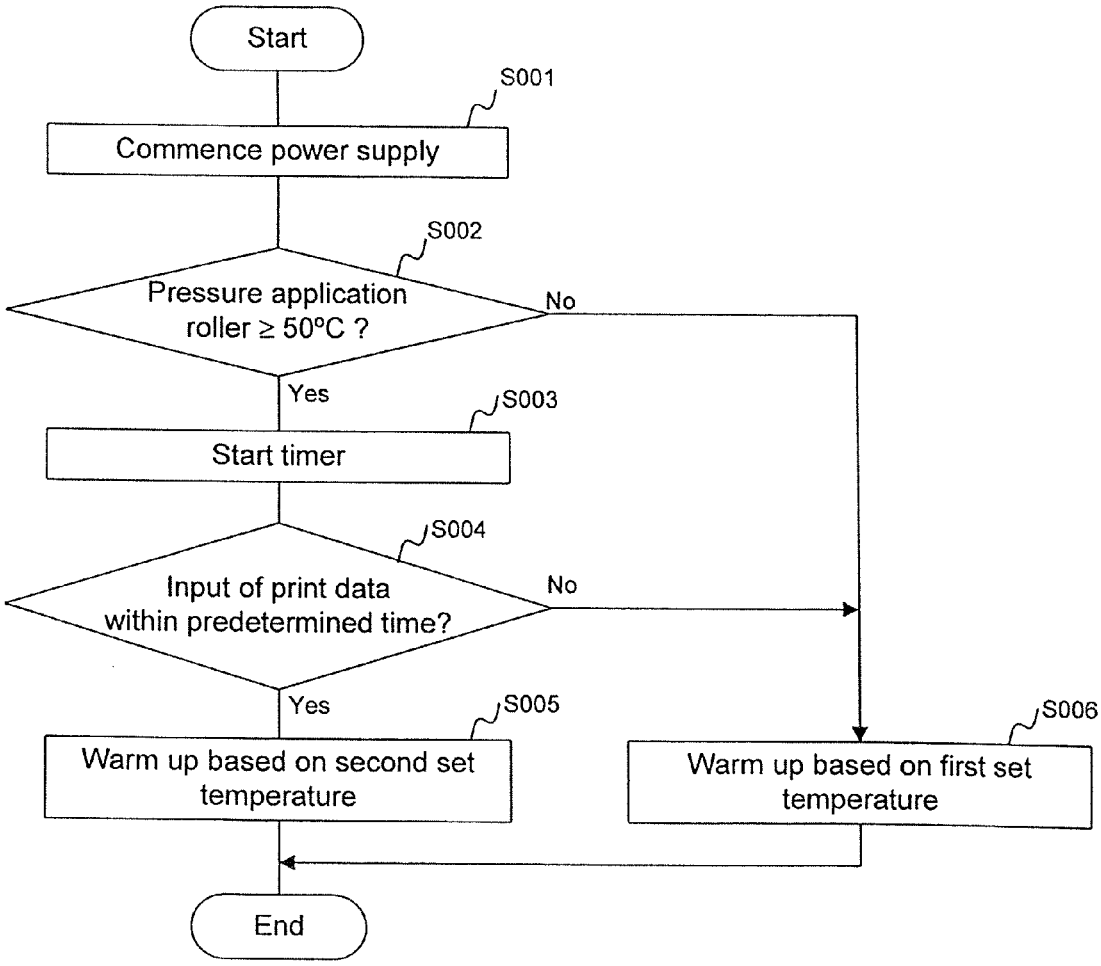
FIG. 7 is a flow diagram for explaining an initial operation according to an embodiment.

FIG. 7 is a flow diagram for describing the initial operation according to the present embodiment. First, at S001, when the power supply is commenced by, for example, turning on the power of the printer 1 by the user, the controller 106, as a temperature control part, sends a command to the temperature detection part 165 to detect the surface temperature of the pressure application roller 45 using the pressure application roller temperature detection element 32.

The temperature detection part 165 that has received the command outputs the surface temperature of the pressure application roller 45 detected by the pressure application roller temperature detection element 32. Then, the controller 106 determines whether or not the inputted surface temperature of the pressure application roller 45 is equal to or greater than 50° C. When the surface temperature of the pressure application roller 45 is equal to or greater than 50° C. (S002, Yes), the controller 106 starts the timer 110 (S003). On the other hand, when the surface temperature of the pressure application roller 45 is less than 50° C. (S002, No), the controller 106 initiates a warm-up operation based on the first set temperature, which is the set temperature for the HTHS print mode (S006).

After the timer 110 is started at S003, the controller 106 determines whether or not print data is inputted within a predetermined time. When the print data is inputted within the predetermined time (S004, Yes), the controller 106 initiates the warm-up operation based on the second set temperature, which is the set temperature for the LTLS print mode (S005) and ends the initial operation. When the print data is not inputted within the predetermined time (S004, No), the controller 106 initiates the warm-up operation based on the first set temperature, which is the set temperature for the HTHS print mode (S006) and ends the initial operation.

Figure 8A:
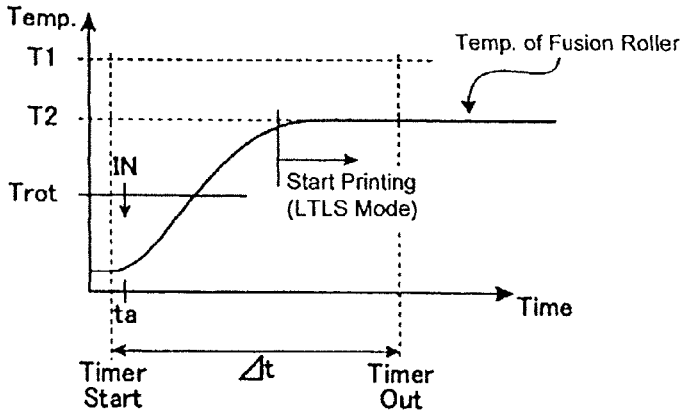
FIGS. 8A-8C are graphs of time vs. temperature of fusion roller relating to selection of a set temperature for the print modes.
Figure 8B:
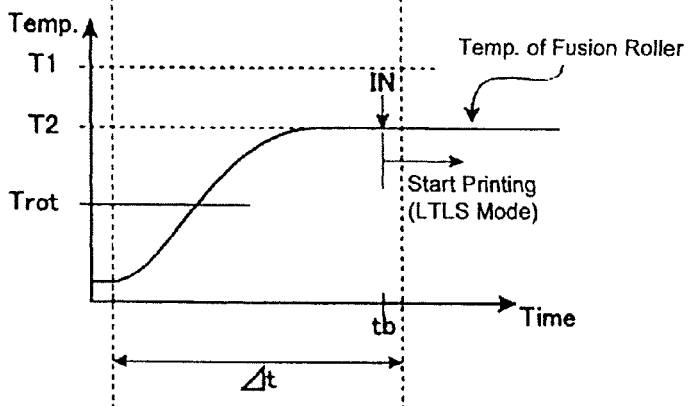
Figure 8C:
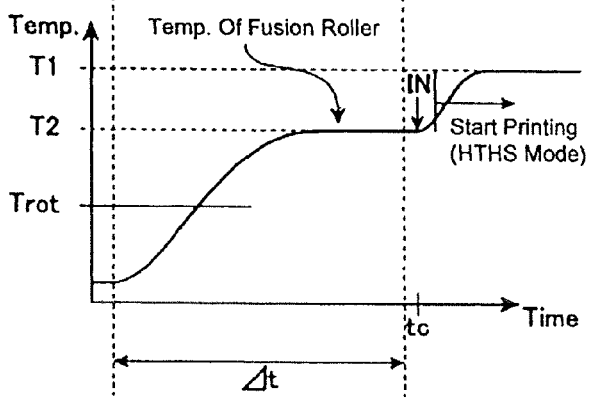

Using FIGS. 8A-8C, selection of the set temperature for the print modes at S004 in FIG. 7 is explained. FIGS. 8A-8C show graphs indicating time elapsed from the commencement of the power supply on the horizontal axis and changes in the surface temperature of the fusion roller 46 on the vertical axis. A time Δt from Timer-Start to Timer-Out on the horizontal axis indicates a predetermined time after starting the timer 110. In addition, Trot on the vertical axis indicates a rotation starting temperature for the fusion roller 46. T2 indicates the second set temperature, and T1 indicates the first set temperature. IN in the graph indicates an input of the print data.

For example, FIG. 8A indicates a case where the print data is inputted shortly after starting the power supply to the printer 1. In FIG. 8A, the surface temperature of the fusion roller 46 has not reached the second set temperature at the time of the input of the print data. Therefore, the controller 106 selects the second set temperature as the set temperature for the print mode and commences the print operation when the surface temperature of the fusion roller 46 reaches the second set temperature.

FIG. 8B indicates a case where the print data is inputted when the surface temperature of the fusion roller 46 has reached the second set temperature within the predetermined time Δt. In this case, the controller 106 selects the second set temperature as the set temperature for the print mode and commences the print operation.

FIG. 8C indicates a case where the print data is inputted after the predetermined time Δt has elapsed. In this case, the controller 106 selects the first set temperature as the set temperature for the print mode and commences the print operation when the surface temperature of the fusion roller 46 reaches the first set temperature.

Figure 9:
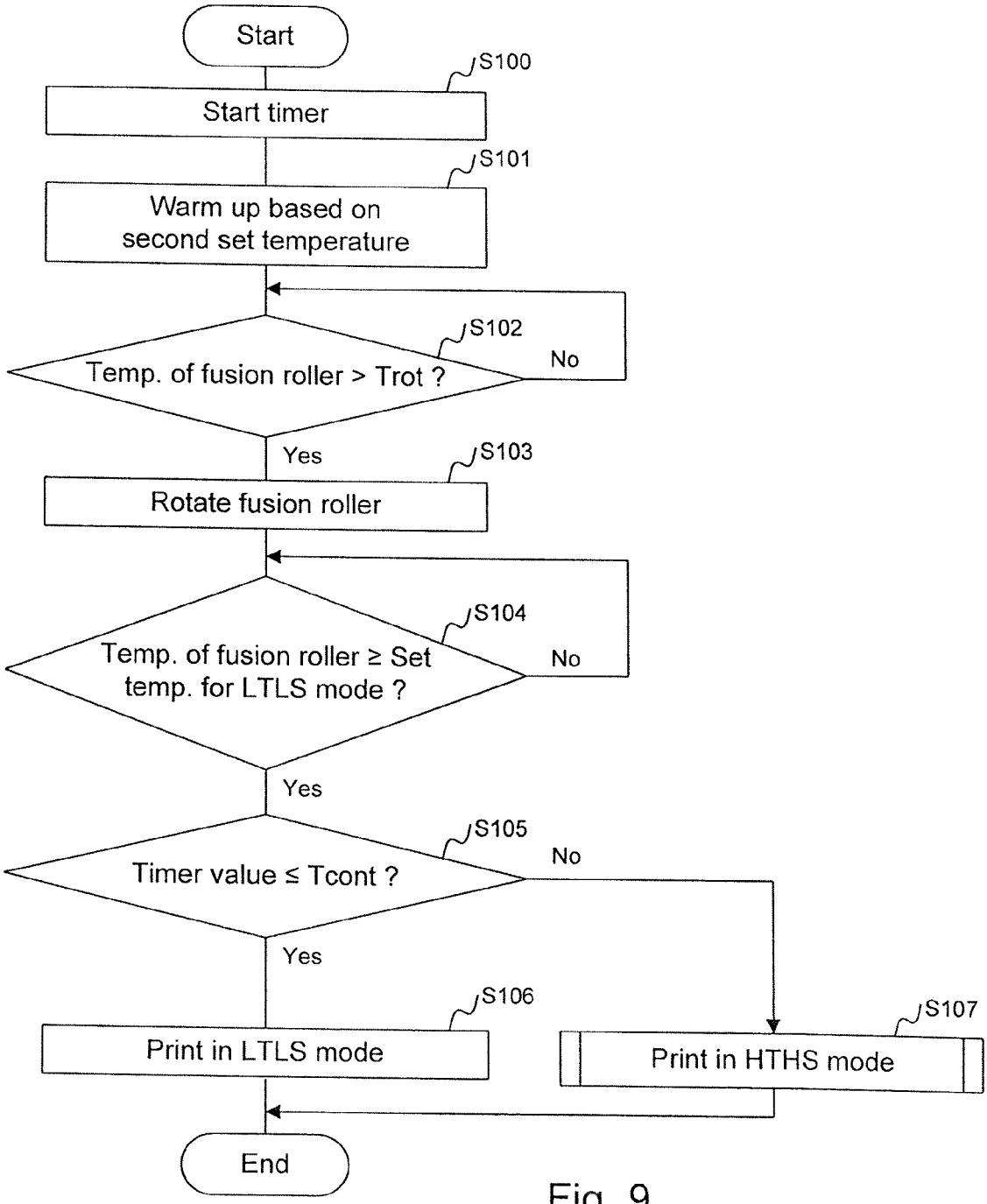
FIG. 9 is a flow diagram for describing an operation when the second set temperature is selected.

Next, the operation in the case where the second set temperature is selected by the controller 106 as the set temperature for the print mode based on the initial operation discussed in the flow diagram in FIG. 7 is explained using a flow diagram in FIG. 9.

When the second set temperature is selected as the set temperature for the print mode, the controller 106 starts the timer 110 (S100) and initiates the warm-up operation based on the second set temperature (S101).

As the fusion roller 46 is heated by increasing the temperature of the heater 104, which is the heat source, the controller 106 sends a command to the temperature detection part 115 to detect the surface temperature of the fusion roller 45 using the fusion roller temperature detection element 31.

The temperature detection part 115 that has received the command outputs the surface temperature of the fusion roller 46 detected by the fusion roller temperature detection element 31. The controller 106 then determines whether or not the inputted surface temperature of the fusion roller 46 is higher than the rotation starting temperature Trot. When the surface temperature of the fusion roller 46 is higher than Trot (S102, Yes), the controller 106 sends a command to the motor drive control part 113 to rotate the fusion roller 46 using the fusion rotation mechanism 173.

The motor drive control part 113 that has received the command starts rotating the fusion roller 46 by controlling the fusion rotation mechanism 173 (S103).

Next, the controller 106 sends a command to the temperature detection part 115 to detect the surface temperature of the fusion roller 46 using the fusion roller temperature detection element 31.

The temperature detection part 115 that has received the command outputs the surface temperature of the fusion roller 46 detected by the fusion roller temperature detection element 31. The controller 106 then determines whether or not the inputted surface temperature of the fusion roller 46 is equal to or greater than the set temperature for the LTLS print mode, that is, the second set temperature (S104).

When the inputted surface temperature of the fusion roller 46 is equal to or greater than the second set temperature (S104, Yes), the controller 106 determines whether or not a timer value of the timer 110 started at S100 is equal to or below predetermined time Tcont (S105). When the timer value of the timer 110 is equal to or below the predetermined time Tcont (S105, Yes), the controller 106 executes the printing in the LTLS print mode (S106). When the timer value of the timer 110 is greater than the predetermined time Tcont (S105, No), the controller 106 executes the printing in the HTHS print mode (S107). As shown in FIGS. 5A and 5B, the setting for the predetermined time Tcont can be appropriately changed in view of the time required for completely ejecting the recording medium in the HTHS print mode or the LTLS print mode. Herein, Tcont is defined as a threshold to determine whether the LTLS print mode or the HTHS print mode first ejects a recording medium.

Figure 10:
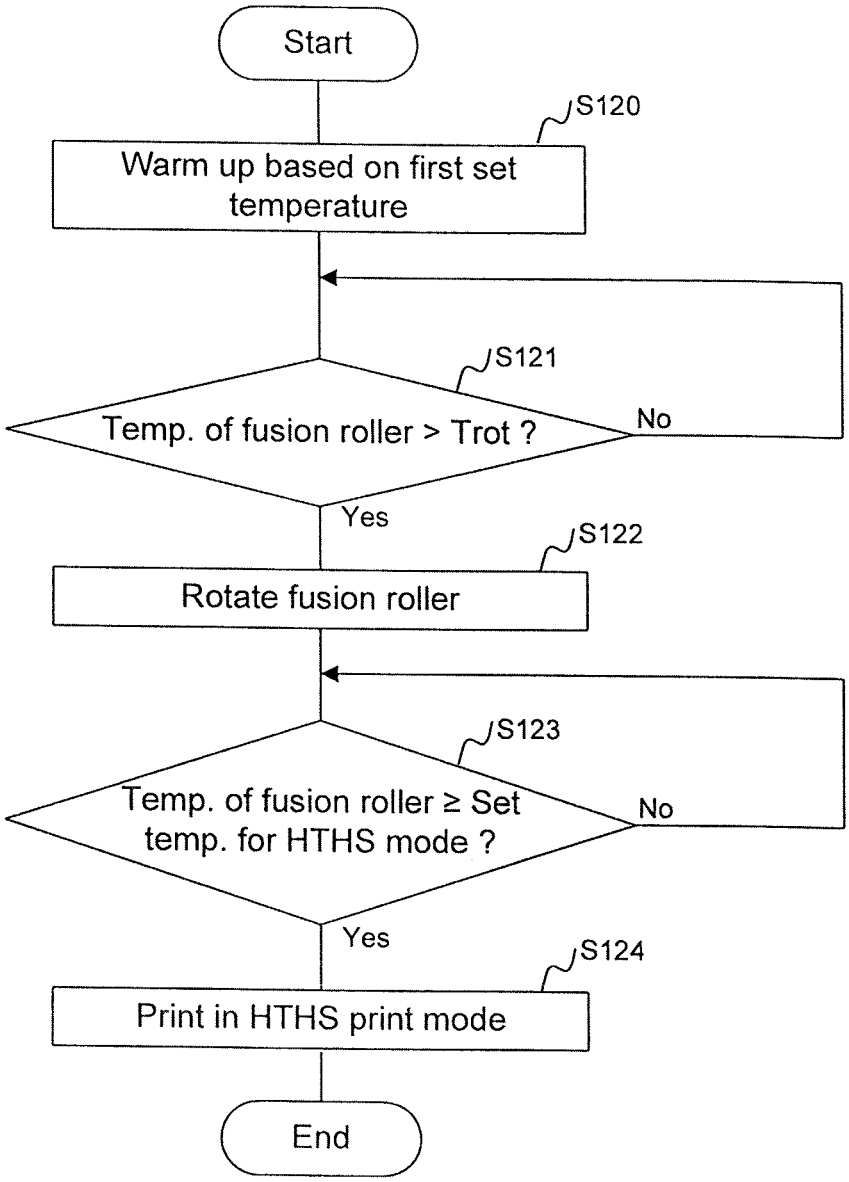
FIG. 10 is a flow diagram for describing an operation when the first set temperature is selected.

Next, an operation in the case where the first set temperature is selected by the controller 106 as the set temperature for the print mode based on the initial operation described in the flow diagram in FIG. 7 is described using a flow diagram in FIG. 10.

The controller 106 commences the warm-up operation based on the first set temperature when the first set temperature is selected as the set temperature for the print mode (S120).

When the fusion roller 46 is heated by increasing the temperature of the heater 104, which is the heat source, the controller 106 sends a command to the temperature detection part 115 to detect the surface temperature of the fusion roller 46 using the fusion roller temperature detection element 31.

The temperature detection part 115 that has received the command outputs the surface temperature of the fusion roller 46 detected by the fusion roller temperature detection element 31. The controller 106 then determines whether or not the inputted surface temperature of the fusion roller 46 is higher than the rotation starting temperature Trot (S121). When the surface temperature of the fusion roller 46 is higher than Trot (S121, Yes), the controller 106 sends a command to the motor drive control part 113 to rotate the fusion roller 46 using the fusion rotation mechanism 173.

The motor drive control part 113 that has received the command starts rotating the fusion roller 46 by controlling the fusion rotation mechanism 173 (S122). When the surface temperature is lower (S121, No), the controller 106 repeats the process until the temperature becomes higher.

Next, the controller 106 sends a command to the temperature detection part 115 to detect the surface temperature of the fusion roller 45 using the fusion roller temperature detection element 31.

The temperature detection part 115 that has received the command outputs the surface temperature of the fusion roller 46 detected by the fusion roller temperature detection element 31. The controller 106 then determines whether or not the inputted surface temperature of the fusion roller 46 is equal to or greater than the set temperature for the HTHS print mode, that is, the first set temperature (S123).

When the inputted surface temperature of the fusion roller 46 is equal to or greater than the first set temperature (S123, Yes), the controller 106 executes the printing in the HTHS print mode (S124). When the surface temperature is lower (S123, No), the controller 106 repeats the process until the temperature becomes higher.

As discussed above, according to the first embodiment, a set temperature for the optimum print mode can be selected based on the detection result of the surface temperature of the pressure application roller. In addition, in the initial operation, even if the set temperature for the LHLS print mode is selected, the time required for completing the printing can be efficiently reduced because either the LTLS print mode or the HTHS print mode can be appropriately selected based on the timer value measured by the timer.

Second Embodiment

In the second embodiment, in addition to the configurations according to the first embodiment, an embodiment is described in which the number of sheets to be printed is considered as a condition for selecting either the LTLS print mode or the HTHS print mode.

First, relationships between the number of sheets to be printed in the LTLS print mode and the HTHS print mode and the time required for the printing are described with reference to FIG. 11.

Figure 11:
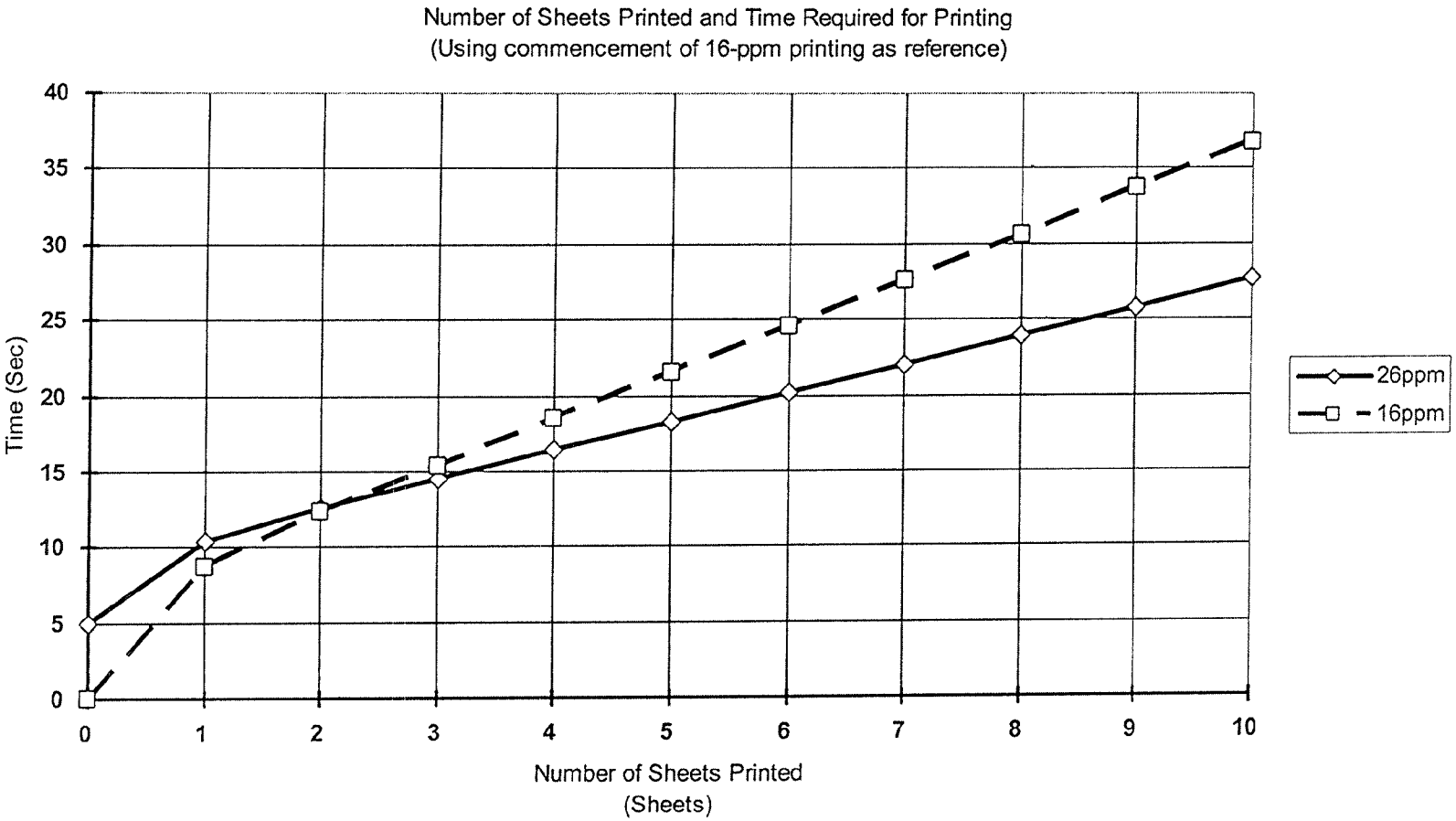
FIG. 11 is a graph showing a relationship between the number of sheets to be printed and time required for printing the sheets.

FIG. 11 is a graph showing the relationship between the number of sheets to be printed and the time required for the printing under the condition defined in the description of FIGS. 5A and 5B according to the first embodiment.

As discussed in FIGS. 5A and 5B, A4-size sheets having a recording medium length of 297 mm are used. A length from the pickup roller 40 to the ejection rollers 47 and 48 is set to 550 mm, and a length from the rear end of the sheet to the front end of the next sheet during the continuous printing is set to 60 mm. A rotational speed of the fusion roller under the HTHS print mode is 26 ppm, and the speed for carrying the recording medium at that time is defined at 158 mm/s. A rotational speed of the fusion roller under the LTLS print mode is 16 ppm, and the speed for carrying the recording medium at that time is defined at 97.5 mm/s. In this case, with the starting time for printing under the LTLS print mode as a reference, the start of the printing under the HTHS print mode is delayed by 5 seconds from the start of the printing under the LTLS print mode. Therefore, the time required for the printing establishes the relationship shown in FIG. 11.

That is, in FIG. 11, the line indicating the number of sheets printed in the LTLS print mode and the line indicating the number of sheets printed in the HTHS print mode intersect each other when the number of sheets printed is "2" on the horizontal axis. This indicates that the time required for the printing in the LTLS print mode becomes longer than the time required for the printing in the HTHS print mode when the number of sheets printed exceeds two (2) in the present embodiment. Therefore, according to the present embodiment, the time required for the printing can be reduced by selecting the LTLS print mode until the number of sheets printed reaches two (2).

Figure 12:
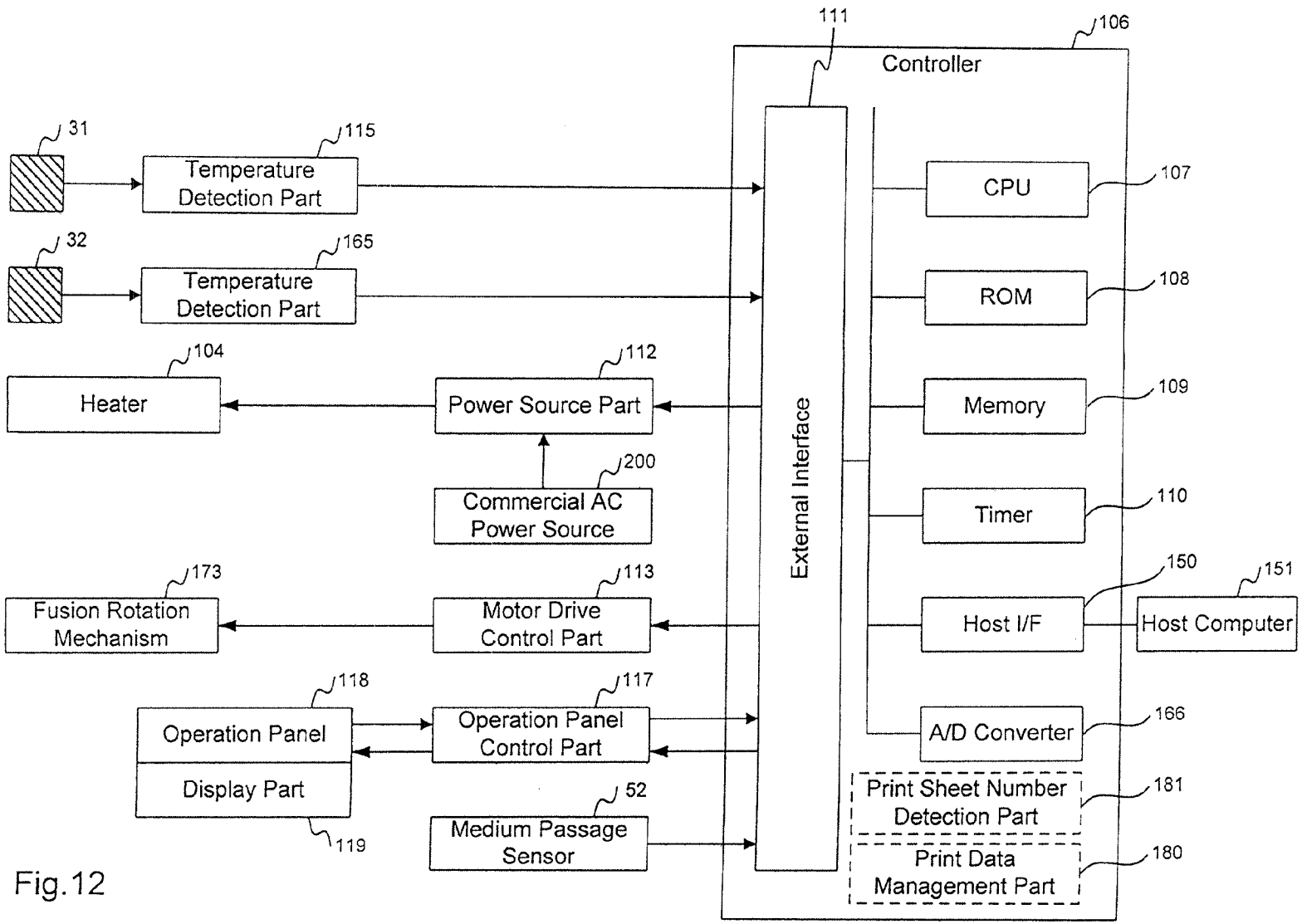
FIG. 12 is a functional block diagram for describing the functional structure of the printer.

A configuration of an embodiment that can select the print mode based on the number of sheets to be printed is described using FIG. 12. Because the configuration according to the present embodiment is approximately the same as the configuration according to the first embodiment, the same elements are referenced by the same symbols, and their descriptions are omitted. Different points are discussed.

As shown in FIG. 12, the functional structure of the printer according to the present embodiment includes a print data management part 180 and a print sheet number detection part 181 in addition to the structure of the first embodiment.

The print data management part 180 manages the print data that is inputted from the host computer 151 via the host I/F 150 and that is stored in the memory 109.

The print sheet number 181 obtains print sheet number information from the print data managed by the print data management part 180.

Figure 13:
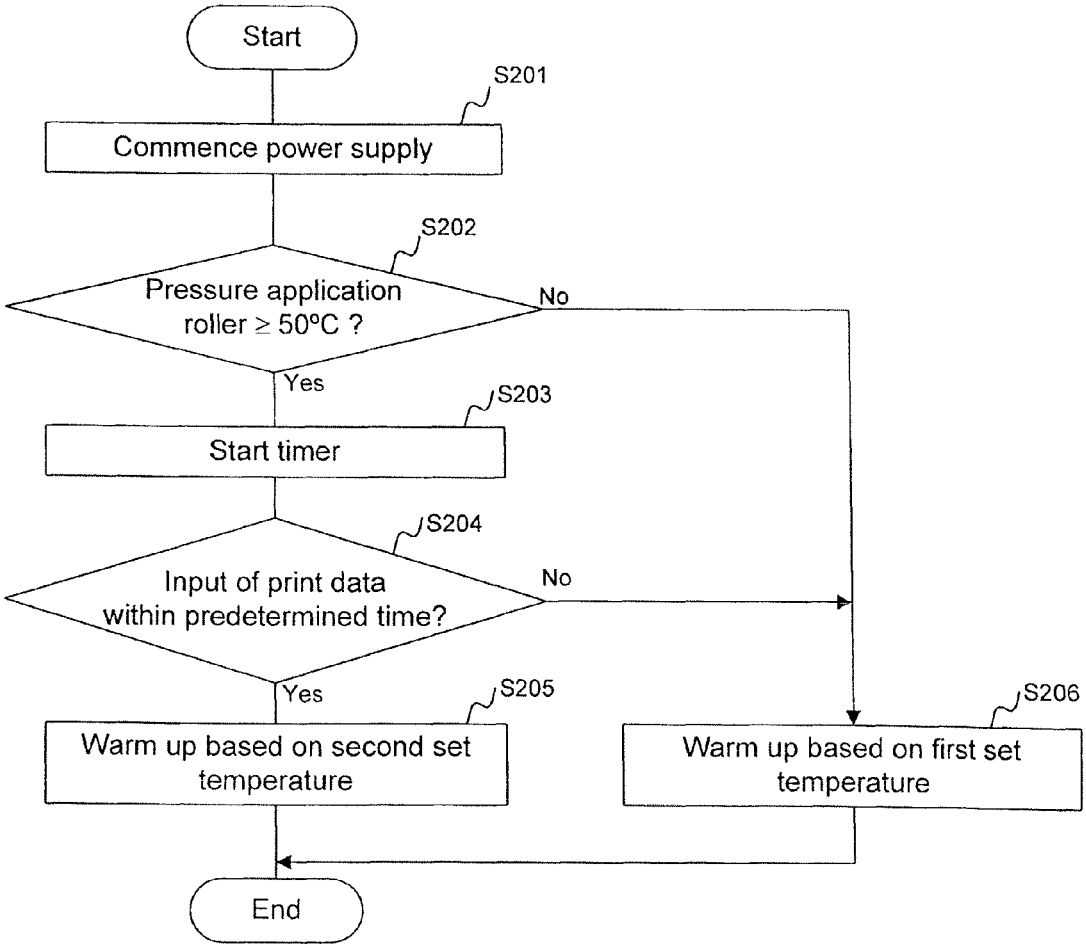
FIG. 13 is a flow diagram for explaining the initial operation according to an embodiment.

Next, the initial operation according to the present embodiment including the above-described configuration is explained using FIG. 13. First, at S201, when the power supply is commenced by, for example, turning on the power of the printer 1 by the user, the controller 106, as a temperature control part, sends a command to the temperature detection part 165 to detect the surface temperature of the pressure application roller 45 using the pressure application roller temperature detection element 32.

The temperature detection part 165 that has received the command outputs the surface temperature of the pressure application roller 45 detected by the pressure application roller temperature detection element 32. Then, the controller 106 determines whether or not the inputted surface temperature of the pressure application roller 45 is equal to or greater than 50° C. When the surface temperature of the pressure application roller 45 is equal to or greater than 50° C. (S202, Yes), the controller 106 starts the timer 110 (S203). On the other hand, when the surface temperature of the pressure application roller 45 is less than 50° C. (S202, No), the controller 106 initiates a warm-up operation based on the first set temperature, which is the set temperature for the HTHS print mode (S206).

After the timer 110 is started at S203, the controller 106 determines whether print data is inputted within a predetermined time. When the print data is inputted within the predetermined time (S204, Yes), the controller 106 initiates the warm-up operation based on the second set temperature, which is the set temperature for the LTLS print mode (S205) and ends the initial operation. When the print data is not inputted within the predetermined time (S204, No), the controller 106 initiates the warm-up operation based on the first set temperature, which is the set temperature for the HTHS print mode (S206) and ends the initial operation.

Figure 14:
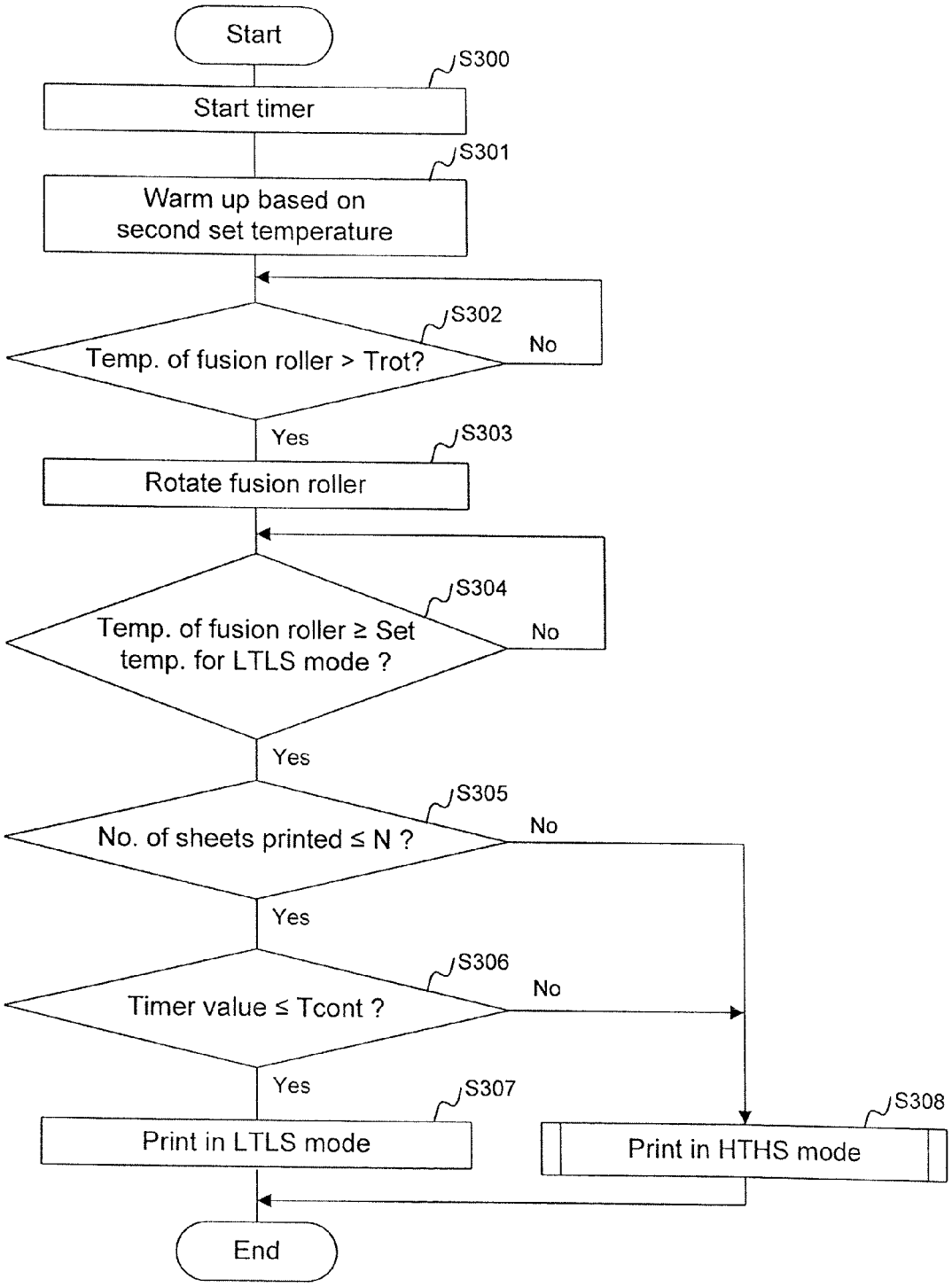
FIG. 14 is a flow diagram that describes an operation when the second set temperature is selected.

Next, the operation in the case where the second set temperature is selected by the controller 106 as the set temperature for the print mode based on the initial operation discussed in the flow diagram in FIG. 13 is explained using a flow diagram in FIG. 14.

When the second set temperature is selected as the set temperature for the print mode, the controller 106 starts the timer 110 (S300) and initiates the warm-up operation based on the second set temperature (S301).

As the fusion roller 46 is heated by increasing the temperature of the heater 104, which is the heat source, the controller 106 sends a command to the temperature detection part 115 to detect the surface temperature of the fusion roller 46 using the fusion roller temperature detection element 31.

The temperature detection part 115 that has received the command outputs the surface temperature of the fusion roller 46 detected by the fusion roller temperature detection element 31. The controller 106 then determines whether or not the inputted surface temperature of the fusion roller 46 is higher than the rotation stating temperature Trot. When the surface temperature of the fusion roller 46 is higher than Trot (S302, Yes), the controller 106 sends a command to the motor drive control part 113 to rotate the fusion roller 46 using the fusion rotation mechanism 173.

The motor drive control part 113 that has received the command starts rotating the fusion roller 46 by controlling the fusion rotation mechanism 173 (S303).

Next, the controller 106 sends a command to the temperature detection part 115 to detect the surface temperature of the fusion roller 46 using the fusion roller temperature detection element 31.

The temperature detection part 115 that has received the command outputs the surface temperature of the fusion roller 46 detected by the fusion roller temperature detection element 31. The controller 106 then determines whether or not the inputted surface temperature of the fusion roller 46 is equal to or greater than the set temperature for the LTLS print mode, that is, the second set temperature (S304).

When the inputted surface temperature of the fusion roller 46 is equal to or greater than the second set temperature (S304, Yes), the controller 106 determines whether or not the number of sheets to be printed obtained from the print data managed by the print data management part 180 is equal to or less than a predetermined N number of sheets (two (2) in the present embodiment), using the print sheet number detection part 181. When the number of sheets to be printed is equal to or less than N(S305, Yes), the controller 106 determines whether or not a timer value of the timer 110 started at S300 is equal to or below a predetermined time Tcont. When the timer value of the timer 110 is equal to or below the predetermined time Tcont (S306, Yes), the controller 106 executes the printing in the LTLS print mode (S307). On the other hand, when the number of sheets to be printed is greater than N(S305, No) or when the timer value of the timer 110 is greater than the predetermined time Tcont (S306, No), the controller 106 executes the printing in the HTHS print mode (S308).

Figure 15:
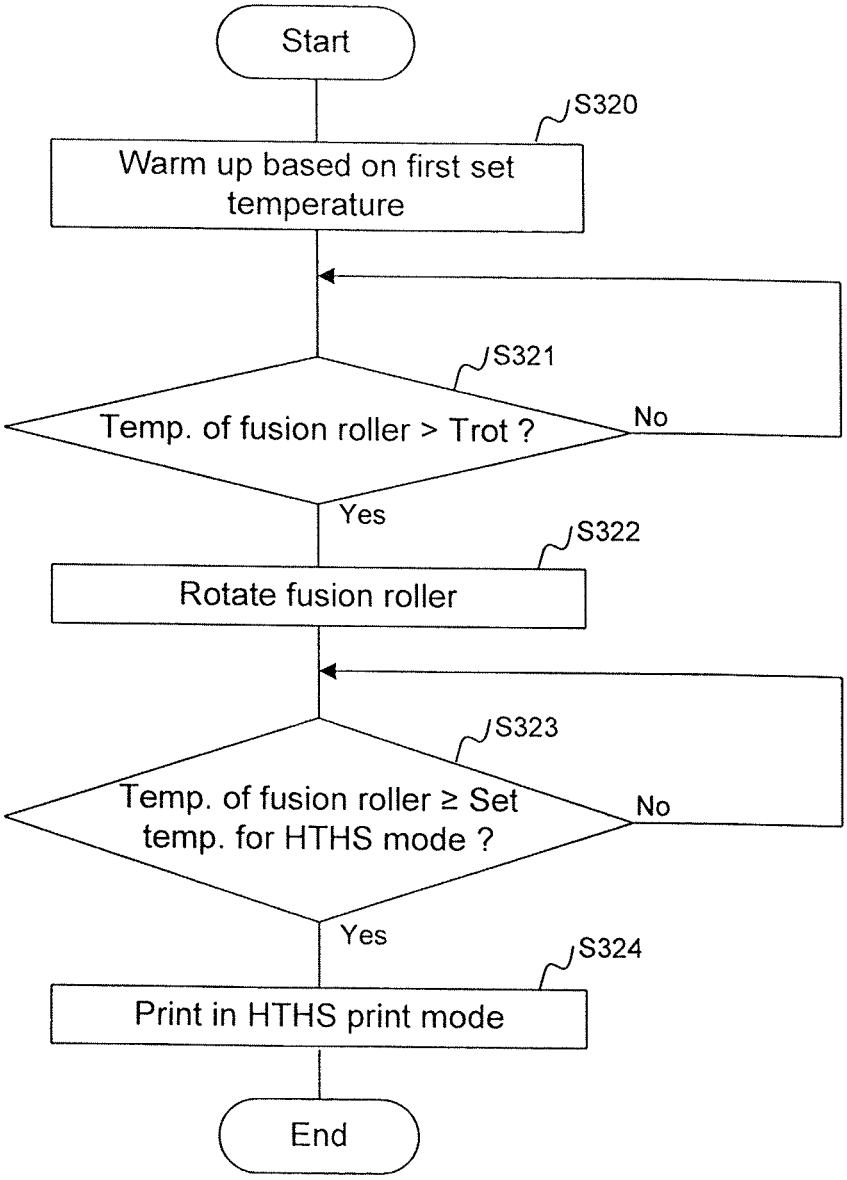
FIG. 15 is a flow diagram that describes an operation when the first set temperature is selected.

Next, an operation in the case where the first set temperature is selected by the controller 106 as the set temperature for the print mode based on the initial operation described in the flow diagram in FIG. 13 is described using a flow diagram in FIG. 15.

The controller 106 commences the warm-up operation based on the first set temperature when the first set temperature is selected as the set temperature for the print mode (S320).

When the fusion roller 46 is heated by increasing the temperature of the heater 104, which is the heat source, the controller 106 sends a command to the temperature detection part 115 to detect the surface temperature of the fusion roller 46 using the fusion roller temperature detection element 31.

The temperature detection part 115 that has received the command outputs the surface temperature of the fusion roller 46 detected by the fusion roller temperature detection element 31. The controller 106 then determines whether or not the inputted surface temperature of the fusion roller 46 is higher that the rotation stating temperature Trot (S321). When the surface temperature of the fusion roller 46 is higher than Trot (S321, Yes), the controller 106 sends a command to the motor drive control part 113 to rotate the fusion roller 46 using the fusion rotation mechanism 173.

The motor drive control part 113 that has received the command starts rotating the fusion roller 46 by controlling the fusion rotation mechanism 173 (S322).

Next, the controller 106 sends a command to the temperature detection part 115 to detect the surface temperature of the fusion roller 46 using the fusion roller temperature detection element 31.

The temperature detection part 115 that has received the command outputs the surface temperature of the fusion roller 46 detected by the fusion roller temperature detection element 31. The controller 106 then determines whether or not the inputted surface temperature of the fusion roller 46 is equal to or greater than the set temperature for the HTHS print mode, that is, the first set temperature (S323).

When the inputted surface temperature of the fusion roller 46 is equal to or greater than the first set temperature (S323, Yes), the controller 106 executes the printing in the HTHS print mode (S324).

As discussed above, according to the second embodiment, the time required for completing the printing can be efficiently reduced because either the LTLS print mode or the HTHS print mode can be appropriately selected based on the number of sheets to be printed, in addition to the effects of the first embodiment.

Figure 16:
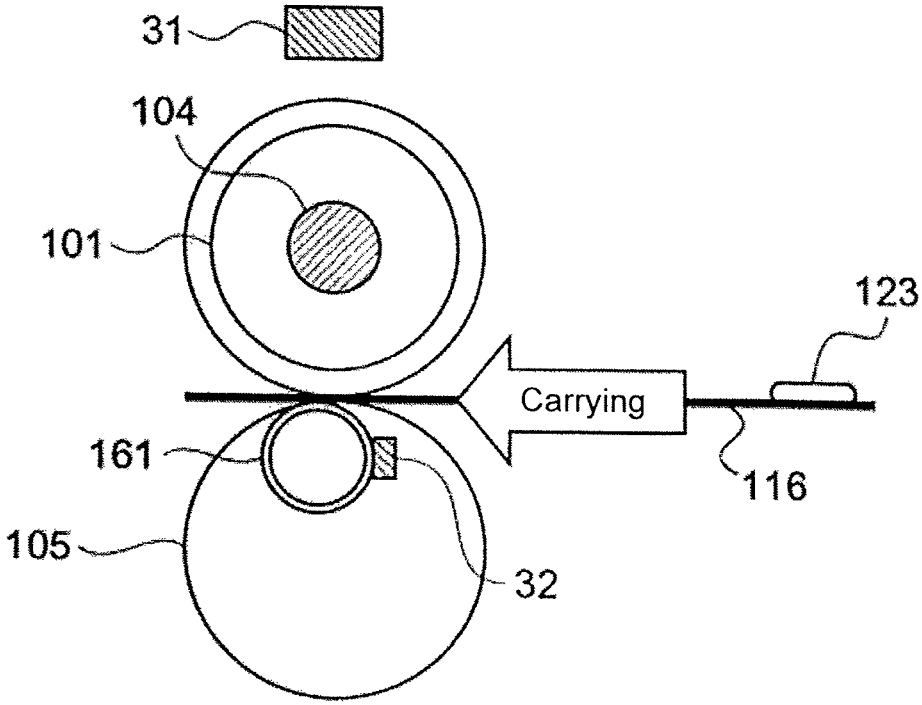
FIG. 16 illustrates the fusion unit.

In the explanation of the embodiments, an exemplary configuration was discussed using the fusion roller 46 and the pressure application roller 45 as members to form the fusion unit 30. However, the formation of the fusion unit 30 is not limited to this configuration. For example, as shown in FIG. 16, the fusion unit 30 may be formed from a fusion roller 101 having a heater 104 and an endless belt 105 having a roller 161 therein instead of the pressure application roller 45. Alternatively, the fusion unit 30 may be formed from endless belts without using either the fusion roller or the pressure application roller. In this case, heat and pressure may be applied to the recording medium, on which the toner image has been transferred, at the timing when the recording medium 2 is carried in the direction of an arrow in the drawing and passes the nip part formed by the fusion roller 101 and the endless belt 105.

In the description of the embodiments of the present invention, a printer was described as an example of the image forming device. However, the present invention is not limited to this and may be used in a multifunctional printer (MFP) device, a facsimile device, a photocopy machine and the like.

What is claimed is:

1. An image forming device that heats and fuses a developer transferred to a surface of a recording medium based on inputted print data, comprising:

a heat source;

a fusion member that is supported in a freely rotatable manner and that is heated by the heat source;

a pressure application member that is positioned to face the fusion member and that presses against the fusion member;

a temperature detection device that is positioned to face the pressure application member and that detects a surface temperature of the pressure application member; and a temperature control part that controls a heating temperature by the heat source based on a detection result by the temperature detection device, wherein the temperature control part determines whether or not the temperature detected by the temperature detection device is greater than a predetermined temperature, performs temperature control on the heat source by selecting, as a target temperature, one of a preset first set temperature or a second set temperature that is lower than the first set temperature, and sets, as the target temperature, the one of the first set temperature and the second set temperature based on whether print data is inputted within predetermined time elapsed from initiating heating by the heat source.

2. The image forming device according to claim 1, further comprising:

a speed control part that controls a rotational speed of the fusion member, wherein the speed control part controls the rotational speed of the fusion member based on the first set temperature or the second set temperature selected by the temperature control part.

3. The image forming device according to claim 2, wherein the rotational speed of the fusion member based on the second set temperature is slower than the rotational speed of the fusion member based on the first set temperature.

4. The image forming device according to claim 1, further comprising:

a timing device that measures elapsed time from a start of heating by the heat source, wherein the temperature control part selects the first set temperature or the second set temperature based on a result of time measurement by the timing device.

5. The image forming device according to claim 1, further comprising:

a sheet number calculation part that calculates a number of image formation sheets, wherein the temperature control part selects the first set temperature or the second set temperature based on a comparison of a result of calculation by the sheet number calculation part and a predetermined number set in advance.

6. The image forming device according to claim 1, wherein if the print data is inputted within the predetermined time, the printing is commenced when the temperature of the fusion member reaches the second set temperature, and if the print data is inputted after the predetermined time has elapsed, the printing is commenced when the temperature of the fusion member reaches the first set temperature.

7. The image forming device according to claim 6, wherein during the printing at the second set temperature, rotational speed of the fusion member is set to second rotational speed, and during the printing at the first set temperature, the rotational speed of the fusion member is set to first rotational speed that is faster than the second rotational speed.

8. An image forming device, comprising:

a heat source;

a freely rotatable fusion member that is heated by the heat source;

a pressure application member that is biased against the fusion member and that is heated by the fusion member;

a first temperature detector that is positioned adjacent to the pressure application member and that is configured to detect a surface temperature of the pressure application member;

a second temperature detector that is positioned adjacent to the heat fusion member and that is configured to detect a surface temperature of the heat fusion member; and a controller that is configured to determine whether or not the temperature detected by the first temperature detector is greater than a predetermined temperature, to control the heat source by selecting, as a target temperature, one of a preset first set temperature or a second set temperature that is lower than the first set temperature, to set, as the target temperature, the one of the first set temperature and the second set temperature based on an input timing of print data indicating whether print data is inputted within predetermined time elapsed from initiating heating by the heat source, and to commence printing in one of a Low Temperature Low Speed (LTLS) mode and a High Temperature High Speed (HTHS) mode based on the input timing of print data and on a temperature of the heat fusion member that is detected by the second temperature detector.

9. The image forming device according to claim 8, wherein the controller is further configured to commence printing in one of the LTLS mode and the HTHS mode based on a number of print medium sheets to be printed.

10. The image forming device according to claim 8, wherein at start-up the controller is further configured to control the heat source to heat the fusion member to a temperature corresponding to the HTHS print mode when the surface temperature of the pressure application member is less than a minimum startup temperature, and to control the heat source to heat the fusion member to a temperature corresponding to the LTLS print mode when the surface temperature of the pressure application member is greater than or equal to the minimum startup temperature.

11. The image forming device according to claim 8, wherein if the print data is inputted within the predetermined time, the printing is commenced when the temperature of the fusion member reaches the second set temperature, and if the print data is inputted after the predetermined time has elapsed, the printing is commenced when the temperature of the fusion member reaches the first set temperature.

12. The image forming device according to claim 11, wherein during the printing at the second set temperature, rotational speed of the fusion member is set to second rotational speed, and during the printing at the first set temperature, the rotational speed of the fusion member is set to first rotational speed that is faster than the second rotational speed.

13. In an image forming device, a method of selecting between a Low Temperature Low Speed (LTLS) printing mode and a High Temperature High Speed (HTHS) printing mode, comprising:

initiating a warm-up operation to heat a fusion roller;

causing the fusion roller to rotate when a temperature of the fusion roller becomes greater than a rotation starting temperature;

receiving print data;

determining whether or not a temperature of a pressure application member is greater than a predetermined temperature;

determining if an amount of elapsed time from the initiating of a warm-up operation is less than or equal to a predetermined value at the time when the print data is received;

setting, as a target temperature, one of a preset first set temperature or a second set temperature that is lower than the first set temperature, based on the determination of the amount of elapsed time;

executing printing in the LTLS mode based on the second set temperature when the amount of elapsed time is less than or equal to the predetermined value; and executing printing in the HTHS mode based on the first set temperature when the amount of elapsed time is greater than the predetermined value.

14. The method according to claim 13, wherein the initiating a warm-up operation to heat a fusion roller further comprising:

commencing a power supply operation;

determining that print data has been input before a predetermined amount of time has elapsed after a temperature of a pressure application roller that is biased against the fusion roller reaches a predetermined pressure application roller temperature.

15. The method according to claim 14, wherein the initiating a warm-up operation to heat a fusion roller further comprising:

commencing a power supply operation;

determining that print data has not been input before a predetermined amount of time has elapsed after a temperature of a pressure application roller that is biased against the fusion roller reaches a predetermined pressure application roller temperature.

16. The method according to claim 13, further comprising prior to the determining if an amount of elapsed time from the initiating of a warm-up operation is less than or equal to a predetermined value, determining if a number of sheets to be printed is less than or equal to a predetermined number when the temperature of the fusion roller is greater than or equal to a set temperature for the LTLS mode; and executing printing in the HTHS mode when the number of sheets to be printed is greater than the predetermined number.

17. The image forming device according to claim 13, wherein if the print data is inputted within the predetermined time, the printing is executed in the LTLS mode when the temperature of the fusion member reaches the second set temperature, and if the print data is inputted after the predetermined time has elapsed, the printing is executed in the HTHS mode when the temperature of the fusion member reaches the first set temperature.

18. The method according to claim 17, wherein during the printing in the LTLS mode, rotational speed of the fusion member is set to second rotational speed, and during the printing in the HTHS mode, the rotational speed of the fusion member is set to first rotational speed that is faster than the second rotational speed.

* * * * *